US005302083A

United States Patent [19]

Bucher et al.

[11] Patent Number: 5,302,083

[45] Date of Patent: Apr. 12, 1994

[54] CEILING FAN WITH NEON LIGHT

[75] Inventors: John C. Bucher, Coral Springs, Fla.; Shih T. Wu; Ta-Yao Tao, both of Taiwan, China

[73] Assignee: Chien Luen Industries Company, Ltd., Inc., Ft. Lauderdale, Fla.

[21] Appl. No.: 937,575

[22] Filed: Aug. 27, 1992

[51] Int. Cl.[5] ..... F04D 19/00

[52] U.S. Cl. ..... 416/5; 362/96; 362/265; 315/219

[58] Field of Search ..... 416/5, 170 R; 362/96, 362/263, 265, 294; 315/219, 244, DIG. 7

[56] References Cited

U.S. PATENT DOCUMENTS

| | | | |
|---|---|---|---|
| 4,149,113 | 4/1979 | Sammis | 315/219 |
| 4,342,073 | 7/1982 | Ranten | 416/5 |
| 4,348,615 | 9/1982 | Garrison et al. | 315/DIG. 7 |
| 4,382,400 | 5/1983 | Stutzman | 416/5 |
| 4,402,649 | 9/1983 | Laurel | 416/5 |
| 4,831,505 | 5/1989 | Van Norman | 362/294 |
| 4,980,611 | 12/1990 | Orenstein | 315/219 |
| 5,001,386 | 3/1991 | Sullivan et al. | 315/219 |
| 5,028,206 | 7/1991 | Kendregan et al. | 416/5 |
| 5,126,637 | 6/1992 | Watts et al. | 315/219 |

FOREIGN PATENT DOCUMENTS

| | | | |
|---|---|---|---|
| 16197 | 1/1988 | Japan | 416/5 |

*Primary Examiner*—Edward K. Look
*Assistant Examiner*—James A. Larson
*Attorney, Agent, or Firm*—Dominik, Stein, Saccocio, Reese, Colitz & Van Der Wall

[57] ABSTRACT

A ceiling fan comprising upper and lower transparent dome-shaped light housings connected together by an annular ring. A neon light is positioned about the fan motor between the light housings such that illumination from the neon tube shines therethrough. Power supply electrical wires extend from the ceiling through the down rod of the fan, then through the hollow shaft of the motor into a switch housing. A light circuit is positioned within the switch housing and connected to the power supply electrical wires. High voltage electrical wires extend from the light circuit through the hollow shaft and to the neon light for powering the neon tube to cause illumination thereof.

4 Claims, 4 Drawing Sheets

CEILING FAN WITH NEON LIGHT

BACKGROUND OF THE INVENTION

1. Field of the Invention

This invention relates to ceiling fans. More particularly, this invention relates to ceiling fans including a neon light.

2. Description of the Background Art

Motor driven fans suspended from the ceiling were used extensively in homes in the United States to provide air circulation before the introduction and popularization of central cooling units.

When the energy crisis dawned in the 1970's, the cost of a kilowatt hour skyrocketed in price and consumers searched for ways to reduce their heating and cooling costs. It has been well established that properly circulated air will raise the overall thermal efficiency of the home air conditioning and cooling system and hence, reduce the cost of maintaining a home at a desired comfort level year-round. Thus, ceiling fans were repopularized in the 1970's.

Indeed, ceiling fans have become so popular that competitiveness in the industry often depends upon the aesthetic features of one ceiling fan versus another. Hence, ceiling fans are usually designed with aesthetically pleasing motor housings and fan blades. Furthermore, a large variety of stylized lights are being designed which may be readily connected to the ceiling fan's switch housing. Most predominantly, such light kits comprise three of four stylized bulb reflectors (for conventional incandescent bulbs), each of which may be pivoted in a different direction for spot lighting.

As a substitute for incandescent lighting, it has recently been proposed to further enhance the aesthetic features of ceiling fans by incorporating neon light tubes into the structure of the fan. For example, in U.S. Pat. No. 5,028,206 entitled "Illuminated Ceiling Fan", issued Jul. 2, 1991, a neon ceiling fan is disclosed including a plurality of neon tubes positioned about each of the fan blades, about the outer periphery of the motor housing, and vertically along the down rod which supports the fan from the ceiling. Unfortunately, a significant safety hazard is created by such positioning in the sense that the neon tubes are exposed and may be readily burst if a consumer (e.g. person or child) accidentally hits the fan with a broom or a toy. Furthermore, the positioning of the neon tubes about the fan blades subjects the neon tubes to excessive centrifugal forces as the fan blades rotate during use. Finally, in order to comply with typical safety standards, such as Underwriters Laboratory (UL), the high-voltage connections to each of the neon tubes must be appropriately insulated and sealed from tampering by the consumer.

Therefore, it is an object of this invention to provide an apparatus which overcomes the aforementioned inadequacies of the prior art devices and provides an improvement which is a significant contribution to the advancement of the ceiling fan art.

Another object of this invention is to provide a ceiling fan comprising an upper and lower dome-shaped housing, means for connecting the upper and lower light housings together to create a space therebetween, motor means positioned within the space between the light housings, the motor means having a rotatable rotor, means for non-rotatably connecting the motor means to a down rod through which extends electrical wires for supplying power to the motor means, a plurality of fan blades connected to the rotatable rotor for rotation when the motor means is powered, a switch housing, switch means contained within the switch housing for controlling the operation of the motor means, at least one neon light positioned within the space between the light housings, the light housings permitting illumination from the neon tube to shine therethrough, and circuit means positioned within the switch housing for powering the neon tube to cause illumination thereof.

Another object of this invention is to provide the ceiling fan as noted above wherein the circuit means comprises in combination means for transforming conventional 120 volt AC power to a high voltage DC power, means for pulsing the high voltage DC power to create substantially AC power at a higher frequency, and means for supplying the AC power at the higher frequency to terminals on the neon tube.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a ceiling fan including a neon light which creates an aesthetically pleasing appearance and provides illumination. More particularly, conventional ceiling fans usually comprise a conventional motor housing rotatably journalled to a conventional down rod which is to be supported by a conventional hanger bracket from the ceiling of the house or other structure. A plurality of fan blades are connected to the underside of the motor housing in a conventional manner so that, upon operation of the motor, the fan blades rotate to provide air circulation within the room. A switch housing extends from the motor housing. The switch housing is configured in a conventional manner allowing conventional light kits to be mounted thereto. The switch housing further includes a conventional motor switch for controlling the operation of the motor. An additional switch may be provided in the switch housing for controlling the operation of the various lights of the light kit (if installed).

Finally, the neon light ceiling fan of the invention comprises a novel transparent, or translucent neon light housing enclosing at least one neon tube positioned about the motor housing. The neon light housing is fixedly positioned at its upper end to the conventional down rod by means of a flange and includes an enlarged bottom opening allowing the fan blades to be connected to the underside of the motor housing, thereby permitting free rotation of the motor housing and the fan blades relative to the stationary neon light housing. Furthermore, the neon ceiling fan of the invention incorporates a novel electrical circuit which creates high-voltage at a high frequency so that a reduced-sized transformer may be employed to power the neon tube.

An important feature of the present invention is the incorporation of the neon light tube within the transparent or translucent light housing. In this manner, the neon tube is fully shielded, with no portions exposed that could be accidentally burst creating a hazardous situation. Furthermore, in compliance with certain safety standards, the neon tube is rendered essentially "non-replaceable" by the average consumer. High-voltage electrical shock hazard to the consumer is therefore eliminated. The use of a small-sized transformer allows the reduced-size transformer and other components of the electrical circuit to be mounted on a printed circuit board and conveniently contained within the switch housing. In this manner, the need for an aesthetically unpleasing auxiliary control box is eliminated.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

As shown in FIGS. 1–4, the neon ceiling fan of the invention comprises upper and lower neon light housings 12 and 14 positioned in an clam-shell manner about an annular center ring 16. An annular neon tube 18 is positioned within the light housings 12 and 14.

Figure 4:
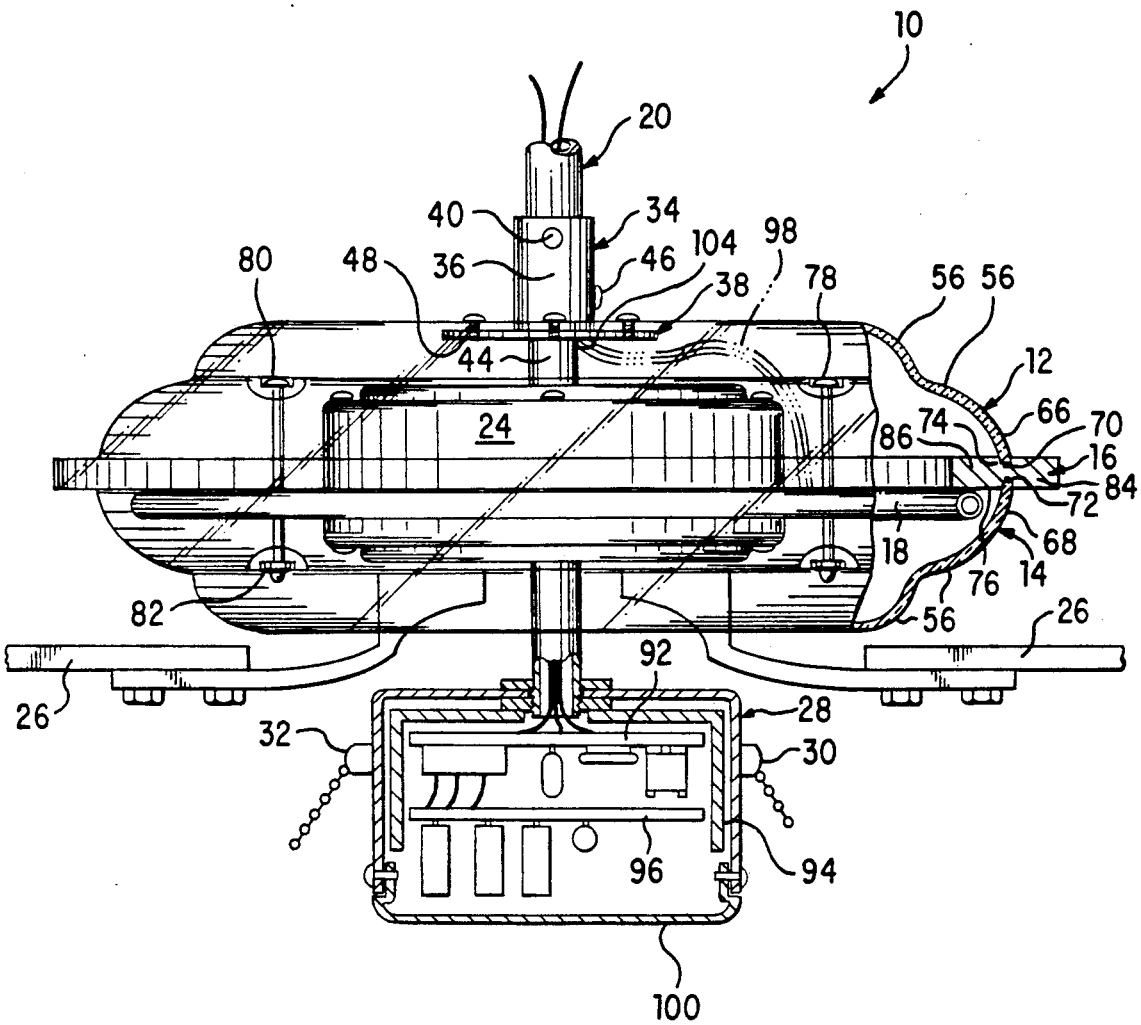
FIG. 4 is a side view of FIG. 1, partially in cross-section, with the fan blades and switch housing attached, illustrating the upper and lower transparent neon light housings positioned about opposing sides of an annular center ring and illustrating the switch housing containing the neon light printed circuit board mounted therein.

As best shown in FIG. 4, the light housings 12 and 14 are manufactured from a translucent or transparent material, such as a translucent or transparent plastic, so that light from the neon tube 18 illuminates through the light housings 12 and 14. The light housings 14 and 16 are rigidly connected relative to a conventional down rod 20 to be stationary therewith. A conventional ceiling fan motor 24 is positioned within the light housings 12 and 14. A plurality of conventional fan blades 26 are connected to the ceiling fan motor 24 to create air circulation within the room. Finally, a switch housing 28 extends from the ceiling fan motor 24, exterially of the light housings 12 and 14, allowing a conventional light kit (not shown) to be connected thereto and controlled by a light switch 30. A motor switch 32 is also positioned in the switch housing 28 for controlling the operation of the motor 24.

Figure 1:
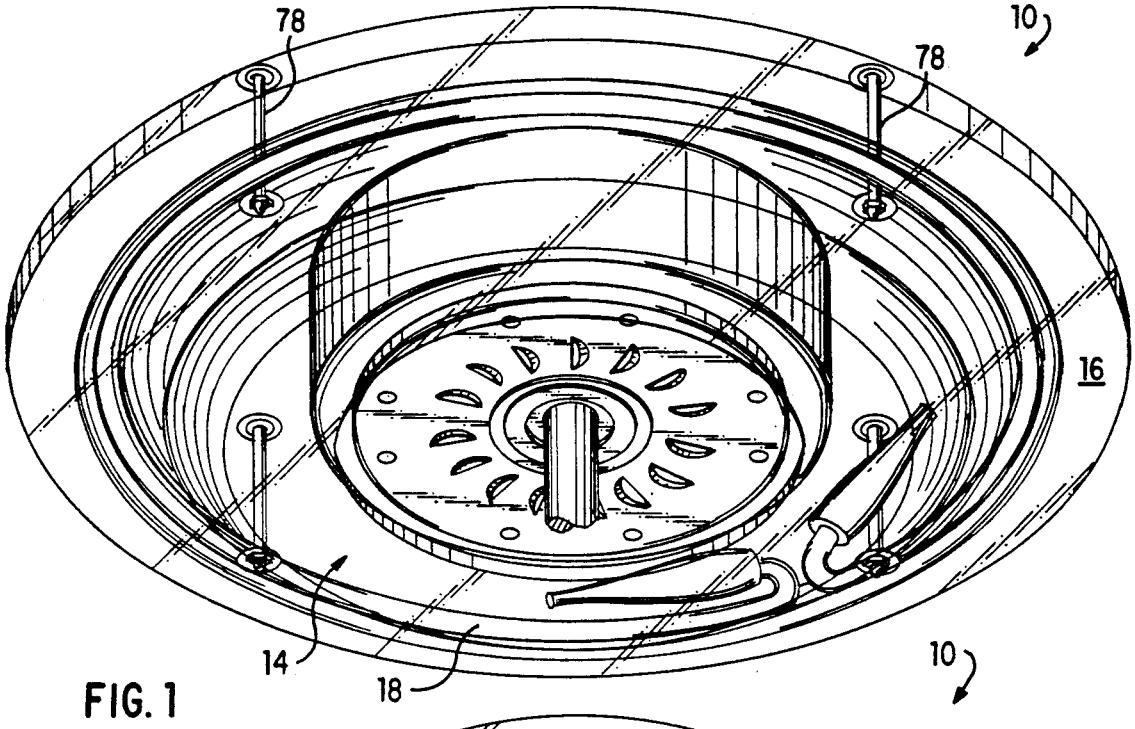
FIG. 1 is a perspective view of the neon ceiling fan of the invention with the fan blades and switch housing removed.
Figure 2:
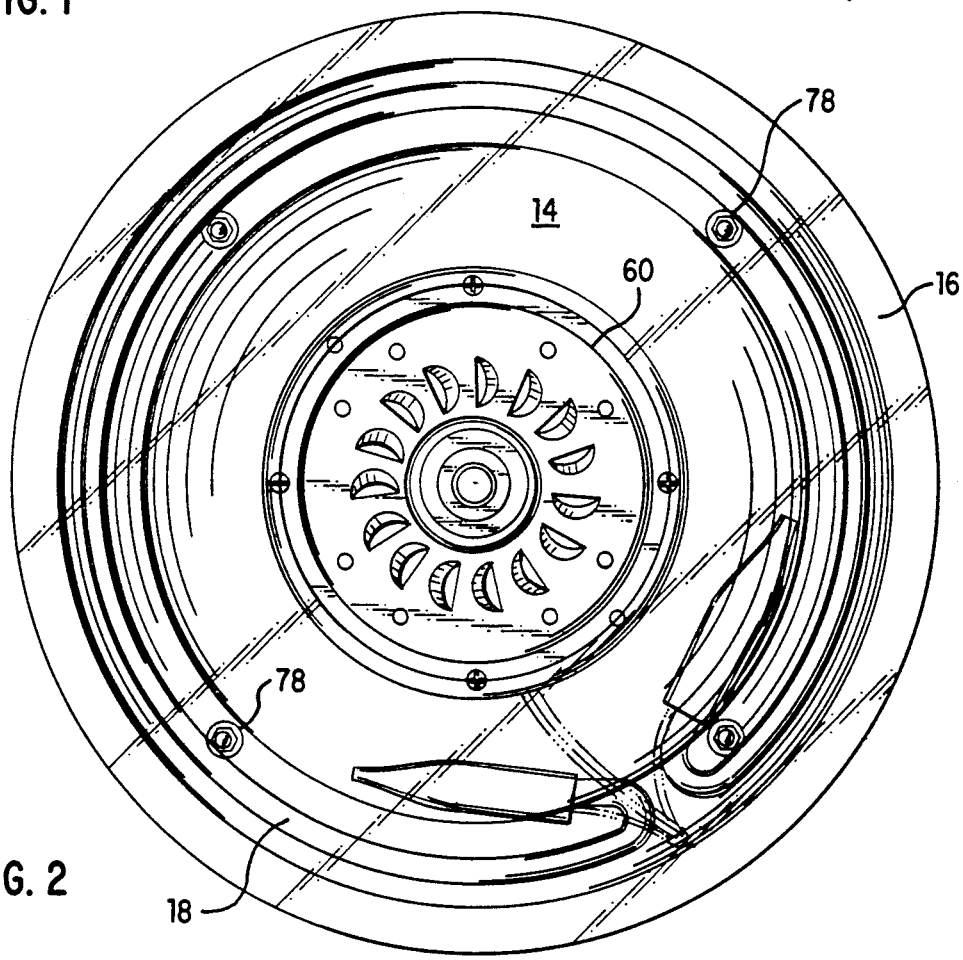
FIG. 2 is bottom view of FIG. 1.
Figure 3:
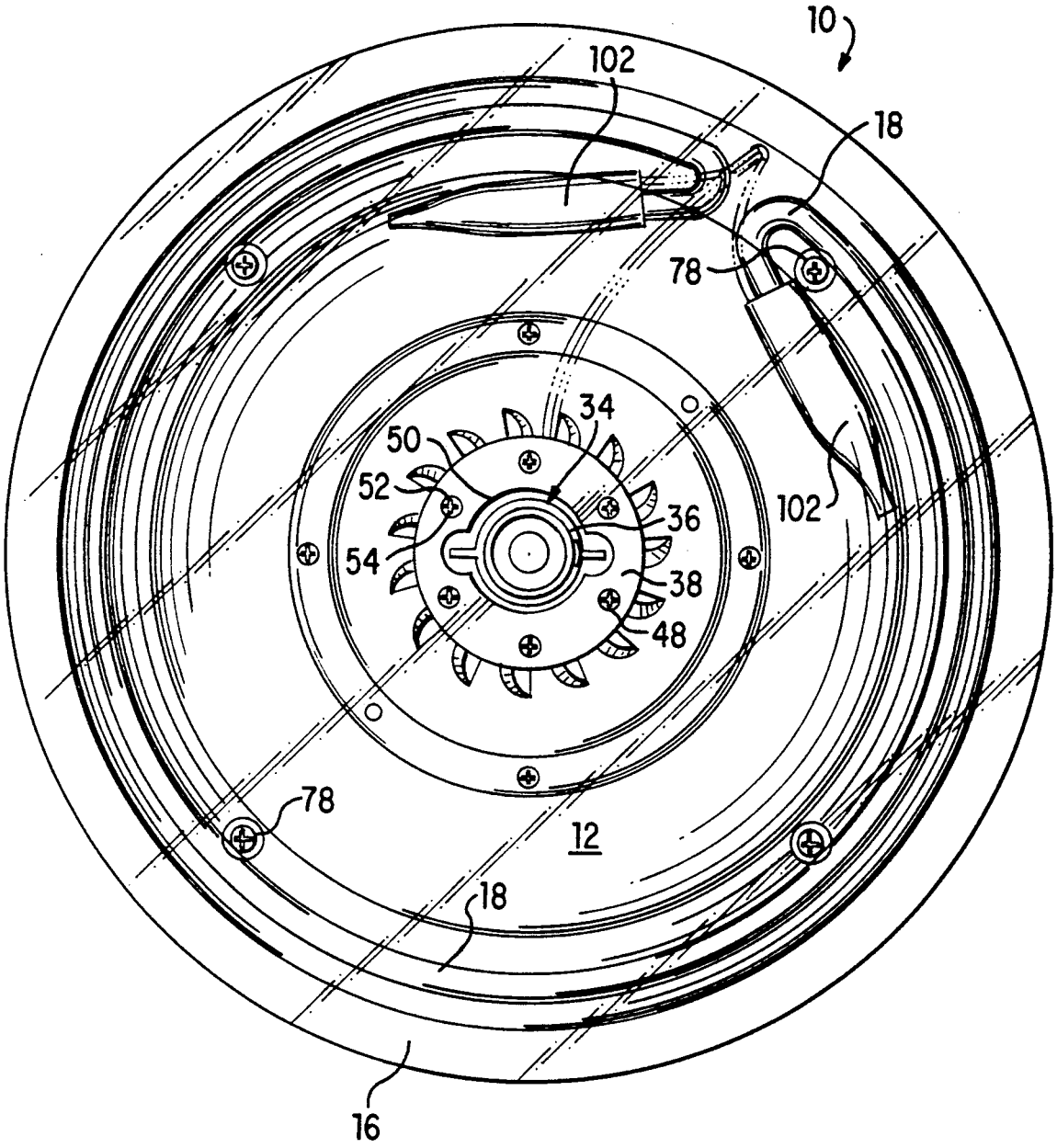
FIG. 3 is a top view of FIG. 1.

More particularly, as best shown in FIGS. 3 and 4, the light housings are connected relative to the down-rod 20 by means of a flanged bracket 34 having a tubular portion 36 and a flange portion 38. The tubular portion 36 includes an upper inner diameter sufficient to receive the end of the down rod 20 therein. A pin 40 is provided for rigidly securing the tubular portion 36 in the down rod 20. The lower portion of the tubular portion 36 includes internal threads (not shown) allowing the hollow shaft 44 of the motor 24 to be threadably connected thereto and secured by set screw 46. The flange portion 38 extends outwardly and includes a plurality of equally spaced threaded holes 48 positioned therethrough.

The upper neon light housing 12 includes a hole 50 of a sufficient diameter to be loosely fitted over the tubular portion 36 of the flanged bracket 34 (see FIG. 3). A plurality of equally-spaced holes 52 are positioned about the hole 50 allowing threaded fasteners 54 to rigidly secure the flange portion 38 of the flanged bracket 34 to the underside of the housing 12.

Both the upper and lower neon light housings 12 and 14 are dome-shaped so as to create sufficient space for the motor 24 to rotate therein. The exterior configuration of the light housings 12 and 14 may include ridges 56 and the like of a variety of configurations so as to create an aesthetically pleasing appearance to the consumer. The lower neon light housing 14 includes an enlarged hole 60 positioned concentrically therein which provides sufficient room for the fan blades 26 to extend therethrough and freely rotate (see FIG. 2).

As noted above, the upper and lower neon light housings 12 and 14 are positioned in a clam-shell manner about the annular center ring 16. More specifically, the annular outer edges 66 and 68 of the upper and lower light housings 12 and 14 include annular steps 70 and 72, respectively. Correspondingly, the annular center ring 16 comprises upper and lower grooves 74 and 76 for receiving the steps 70 and 72 during assembly, thereby assuring concentric assembly of the light housings 12 and 14 relative to the center ring 16. Once concentrically positioned, the upper and lower light housings 12 and 14 are securely fastened about the center ring 16 by means of threaded fasteners 78 (e.g. as nuts and bolts) which extend through corresponding holes 80 and 82 in the upper and lower housing 12 and 14. A permanent adhesive may be used on the fasteners 78 to prevent a consumer from gaining access to the neon tube 18.

The annular center ring 16 comprises a generally rectilinear cross section of a significant width such that a significant portion 84 extends outwardly beyond the light housings 12 and 14 to enhance the aesthetic appearance of the fan 10. The center ring further includes an interior portion 86 which extends significantly into the interior of the light housing 12 and 14. Preferably, the interior portion 86 of the center ring 16 extends sufficiently inward to be approximately equal to the diameter of the neon tube 18 such that the neon tube 18 is captured between the interior portion 86, the curvature of the lower housing 14, and the threaded fasteners 78, thereby securely retaining the neon tube 18 into position.

Figure 5:
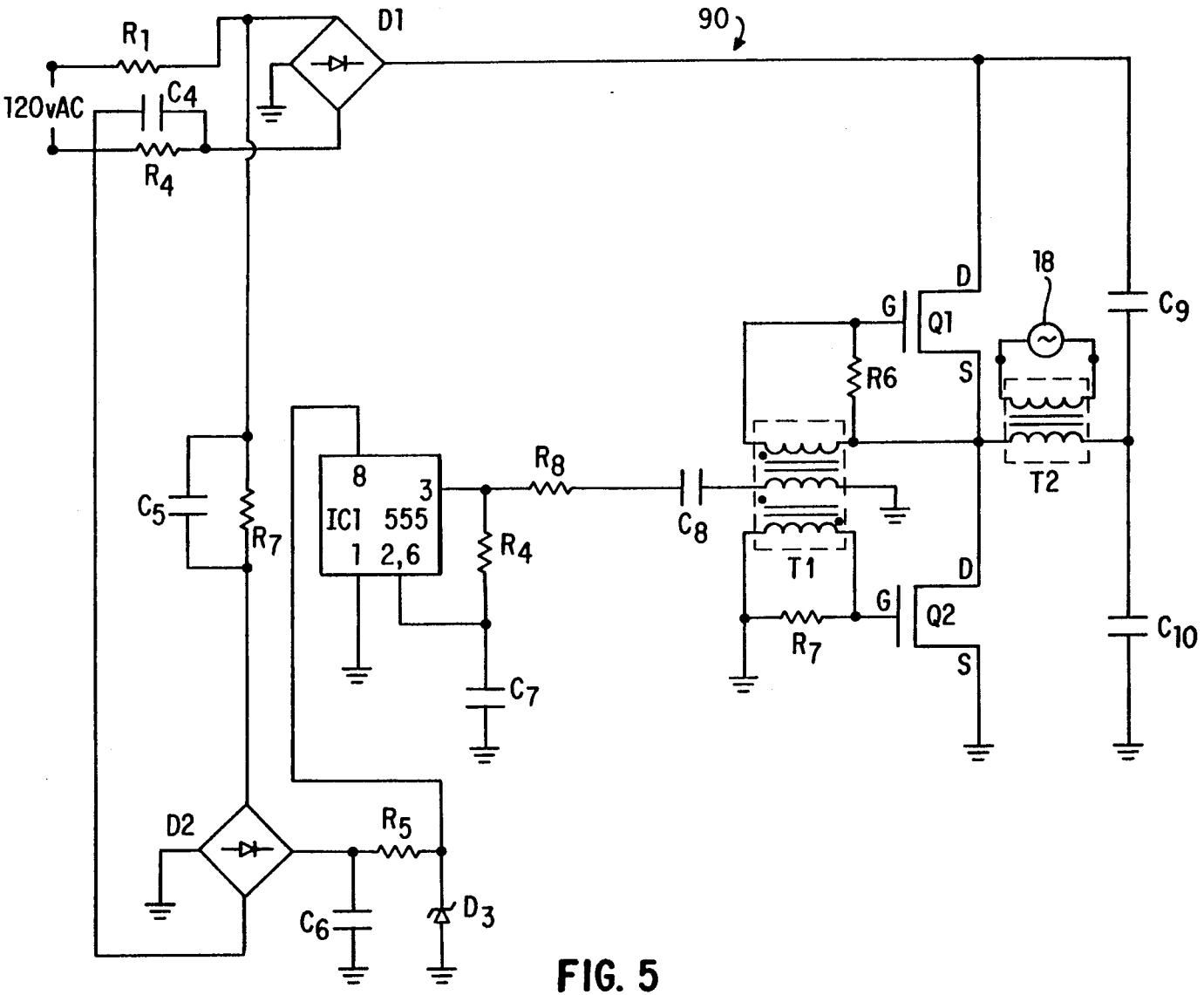
FIG. 5 is a schematic diagram illustrating the neon light circuit of the invention.

As shown in FIG. 5, the neon ceiling fan 10 of the invention further comprises a novel electrical circuit 90 for powering the neon tube 18. More specifically, conventional 120 volt AC household power is supplied to a diode bridge D1 which produces essentially DC voltage at its output. The DC output of the diode bridge D1 is supplied to the drain terminal of a N-MOSFET transistor Q1 having its source terminal connected to the drain terminal of another N-MOSFET transistor Q2 with its source terminal connected to ground. The source and drain terminals of the transistors Q1 and Q2, respectively, are then connected to one terminal of the primary winding of a high voltage transformer T2 having a high winding ratio so as to produce high voltage DC at its secondary winding from the lower DC voltage from bridge D1. Capacitors $C_9$ and $C_{10}$ are respectively connected from the output of the diode bridge D1 to the other terminal of the primary winding and from the primary winding to ground.

The circuit 90 of the invention further includes means for pulsing the high voltage output. Specifically, conventional 120 volt AC household power is supplied to another rectifier bridge D2 having its essentially DC voltage output regulated at 15 volts by means of zener diode D3 and capacitor $C_6$ and resistor $R_5$, which is then supplied to the supply (pin 8) of an astable multivibrator employing a 555 integrated circuit IC1. Capacitor $C_7$ is connected to the multivibrator's trigger/threshold terminals (pins 2,6) to ground. Resistor $R_4$ is connected to the multivibrator's output (pin 3) and to trigger/threshold terminals (pins 2,6). During power-up, the output (pin 3) of the multivibrator IC1 goes high and charges capacitor $C_7$ until approximately two-thirds of the supply voltage is detected by threshold input (pin 6), whereupon the output (pin 3) goes low. While low, output (pin 3) permits capacitor $C_7$ to discharge through resistor $R_4$ until the voltage on capacitor $C_7$ decreases to one-third of the supply voltage, whereupon the trigger input (pin 2) flips the multivibrator to its initial state. The cycle repeats astably to produce a pulsed output.

The pulsed output of the multivibrator IC1 is supplied through resistor $R_8$ and capacitor $C_8$ to the primary winding of a three-winding driver distribution transformer T1 having two secondary windings such that each secondary winding is pulsed. The secondary windings of the driver transformer T1, with Resistors $R_6$ and $R_7$ connected in parallel, are then respectively supplied in reverse polarities to the gates of the MOSFETs $Q_1$ and $Q_2$. It should therefore be appreciated that the high voltage DC output of the high voltage transformer T2 is pulsed at a high frequency which is sufficient to drive the neon tube 18.

Preferably, the components of the above-described circuit 90 as set forth in the following table are employed so as to produce an output voltage of nearly 1,000 volts at 20,000 kilohertz so as to power the neon tube 18.

| | |
|---|---|
| D1 | RB154 |
| D2 | RB152 |
| D3 | 15V/Y2W |
| Q1 | IRF630 |
| Q2 | IRF630 |

-continued

| | |
|---|---|
| T1 | EE-19 |
| T2 | EE-25 (60:700 EI 28) |
| IC1 | NE555 |
| $C_4$ | 6.0 μf/250 V |
| $C_5$ | 1.2 μf/250 V |
| $C_6$ | 100 μf/25 V |
| $C_7$ | M/C 102 |
| $C_8$ | 0.47 μf/V |
| $C_9$ | 1.0 μf/V |
| $C_{10}$ | 1.0 μf/V |
| $R_1$ | K/½ W |
| $R_2$ | K/¼ W |
| $R_3$ | K/¼ W |
| $R_4$ | K/¼ W |
| $R_5$ | K/¼ W |
| $R_6$ | 1.K/¼ W |
| $R_7$ | 1.K/¼ W |
| $R_8$ | K/¼W |

The above-described circuit 90 is preferably mounted onto a printed circuit board 92 which is insulatively positioned within a plastic support cup 94 in the switch housing 28. A printed circuit board 96 is preferably then stacked adjacent the printed circuit board 92 in the switch housing 28 and typically contains start capacitors and other circuitry employed for multi-speed operation of the motor 24. In this manner, the high voltage components of the neon light circuit 90 mounted on printed circuit board 92 will not be exposed to the consumer should the consumer open the access cover 100 of the light switch 30 so as to mount a light kit. Finally, it is noted that the high voltage wires 98 connected to the output of the high voltage transformer T2 extend through the hollow shaft 44 of the motor and the exits therefrom through hole 104 to be connected to the respective ends of the neon tube 18. Preferably, the wires are permanently connected to the neon tube 18 and permanently insulated by sleeves by 102 (see FIG. 3) so as to comply with various safety standards.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A ceiling fan, comprising in combination:

upper and lower dome-shaped light housings, said light housings being light emissive;

annular ring means for connecting said upper and lower light housings together to create a space therebetween;

a motor including a stator and rotor, said rotor being journalled on a hollow shaft in said stator, said motor being positioned within said space between said light housings;

a plurality of fan blades connected relative to said rotor of said motor to rotate therewith;

means for non-rotatably connecting said stator of said motor to a down rod with an upper end of said hollow shaft of the motor being in colinear alignment therewith;

a switch housing mounted to a lower end of said hollow shaft;

power supply electrical wires extending through said down rod and said hollow shaft of said motor into said switch housing;

motor switch and circuit means positioned within said switch housing, said motor switch and circuit means being connected to said power supply electrical wires and to said motor for controlling the operation of said motor;

a neon light positioned within said space between said light housings such that illumination from said neon light shines therethrough; and light circuit means positioned within said switch housing, said light circuit means being connected to said power supply electrical wires and having high voltage electrical wires extending therefrom through said hollow shaft to said neon light for powering said neon light to cause illumination thereof, said light circuit means including means for transforming AC power supplied by said power supply electrical wires to a high voltage DC power, means for pulsing said high voltage DC power to create substantially AC power at a higher frequency, and means for supplying said AC power at said higher frequency to terminals of said neon tube.

2. The ceiling fan as set forth in claim 1, wherein said transforming means comprises an AC/DC rectifier and a transformer.

3. The ceiling fan as set forth in claim 1, wherein said pulsing means comprises:

an astable multivibrator means for supplying at an output a series of pulses at said higher frequency; and distribution transformer means having a primary winding connected to said output of said astable multivibrator means and two secondary windings respectively connected in opposite polarities to inputs of two semiconductor switches to switch said high voltage DC power to said high voltage AC at said higher frequency.

4. The ceiling fan as set forth in claim 3, wherein said astable multivibrator comprises a 555 timer having supply voltage, trigger, threshold and output terminals, a capacitor connected between said trigger and threshold terminals and electrical ground, and a resistor connected to said trigger and threshold terminals and said output terminal whereby during power-up, said output terminal goes high and charges said capacitor until approximately two-thirds of the supply voltage is detected by said threshold terminal, whereupon said output terminal goes low, and while low, said output terminal permits said capacitor to discharge through said resistor until the voltage on said capacitor decreases to one-third of the supply voltage, whereupon said astable multivibrator means flips to its initial state and cyclically repeats the above.

* * * * *